United States Patent [19]

Lucke

[11] 4,320,979

[45] Mar. 23, 1982

[54] MIXER

[75] Inventor: Roland Lucke, Paderborn, Fed. Rep. of Germany

[73] Assignee: Gebr. Lodige Maschinenbau GmbH, Fed. Rep. of Germany

[21] Appl. No.: 104,816

[22] Filed: Dec. 18, 1979

Related U.S. Application Data

[63] Continuation-in-part of Ser. No. 873,865, Jan. 31, 1978, abandoned.

[51] Int. Cl.[3] ..... B01F 7/04

[52] U.S. Cl. ..... 366/325

[58] Field of Search ..... 366/325, 329, 326, 327, 366/328, 342, 343, 279, 330

[56] References Cited

U.S. PATENT DOCUMENTS

| | | | |
|---|---|---|---|
| 661,796 | 11/1900 | Ernst | 366/329 |
| 2,024,481 | 12/1935 | Simpson | 366/329 |
| 2,570,042 | 10/1951 | West | 366/66 |
| 2,750,163 | 6/1956 | Loedige | 366/327 |
| 3,071,352 | 1/1963 | McIntyre | 366/325 |

FOREIGN PATENT DOCUMENTS

| | | | |
|---|---|---|---|
| 1101113 | 3/1961 | Fed. Rep. of Germany | 366/329 |
| 1223838 | 3/1971 | United Kingdom | 366/325 |

*Primary Examiner*—Robert W. Jenkins
*Attorney, Agent, or Firm*—Thomas J. Greer, Jr.

[57] ABSTRACT

A mixer is provided comprising a container having a circumferential wall, and a mixing mechanism arranged for concentric rotation with respect to the container. The mixing mechanism comprises a rotatably mounted shaft carrying at least one pair of radially extending arms each of which has a mixing tool therein. One mixing tool of the or each pair is located in the immediate vicinity of the container wall, and the other mixing tool of the or each pair is located at a smaller radial distance from the shaft. The latter mixing tool is disposed in advance of the former mixing tool, as considered in the direction of rotation of the mixing mechanism. In an embodiment, a single radially extending arm is employed. This arm carries a mixing tool and a second arm, the latter in turn provided with a second mixing tool.

5 Claims, 2 Drawing Figures

MIXER

This application is a continuation-in-part of my application Ser. No. 873,865, filed Jan. 31, 1978, now abandoned.

FIELD OF THE INVENTION

The invention relates to a mixer comprising a container and a mixing mechanism arranged concentrically therein which comprises a rotatably mounted shaft bearing radially extending arms having mixing tools in the form, for example, of plough-shares.

The invention relates, in particular, to a drum mixer or to a trough mixer with a horizontal shaft.

BACKGROUND OF THE INVENTION

In known mixers of this type the mixing tools are arranged at the ends of the radial arms of the mixing mechanism in such a way that they revolve close to the internal wall of the container and are thus immersed completely in the product being mixed, particularly if the mixer is operated with a high degree of filling. If the mixing mechanism is operated at a relatively low speed most of the product to be mixed lies in the lower region of the container and the individual mixing tools have to run submerged through a pile of product being mixed. The individual mixing tools are thus subjected to greatly varying loads which depend upon the level to which the mixer is filled and the thickness of the layer of product above the submerged mixing tool. This produces considerable wear on the mixing tools and means that the mixing mechanism requires high power to operate it.

OBJECT OF THE INVENTION

The object of the invention is to reduce the load on the mixing tools and the arms thereof and thus to reduce the power requirement of the mixing mechanism in mixers of the type mentioned above also to reduce wear on the mixing tools.

SUMMARY OF THE INVENTION

The invention provides a mixer comprising a container having a circumferential wall, a mixing mechanism arranged for concentric rotation with respect to the container, the said mixing mechanism comprising a rotatably mounted shaft carrying at least one pair of radially extending arms each of which has a mixing tool therein, one mixing tool of the pair being located in the immediate vicinity of the container wall, and the other mixing tool of the pair being located at a smaller radial distance from the shaft than the said one mixing tool and being disposed in advance of the said one mixing tool as considered in the direction of rotation of the mixing mechanism.

In the mixer according to the invention, therefore each mixing tool adjacent the wall of the container (the main mixing tool) is provided with an additional tool in advance thereof these two tools being immersed in different layers of the mix product. The additional tool splits the product being mixed in front of the main tool so that less energy is required for ploughing through the product with the main tool. This is particularly advantageous if the mixer is operated with a high degree of filling and if the main tool is accordingly immersed deep into the product being mixed. The total energy required by the mixing mechanism and the wear on the mixing tools may be reduced in this way, particularly when using mixing tools having the form of plough-shares.

In one embodiment of the invention, the shaft of the mixing mechanism carries a pair of arms of different lengths, the arms of the pair lying in a common radial plane and having mixing tools arranged at their ends. In this case, the length of the shorter arms is advantageously such that the additional mixing tools are submerged at least once in the product being mixed during each rotation.

In another embodiment, the shaft of the mixing mechanism carries a single, radially extending arm whose outer end carries a mixing tool in the immediate vicinity of the container wall. This arm also carries a second arm, shorter than the first, and generally perpendicular thereto. The outer, free, end of this second arm also carries a mixing tool, but at a smaller radial distance from the shaft.

The invention is particularly suitable for large-sized mixers which are operated with a degree of filling of above 50%.

DETAILED DESCRIPTION OF THE INVENTION

Figure 1:
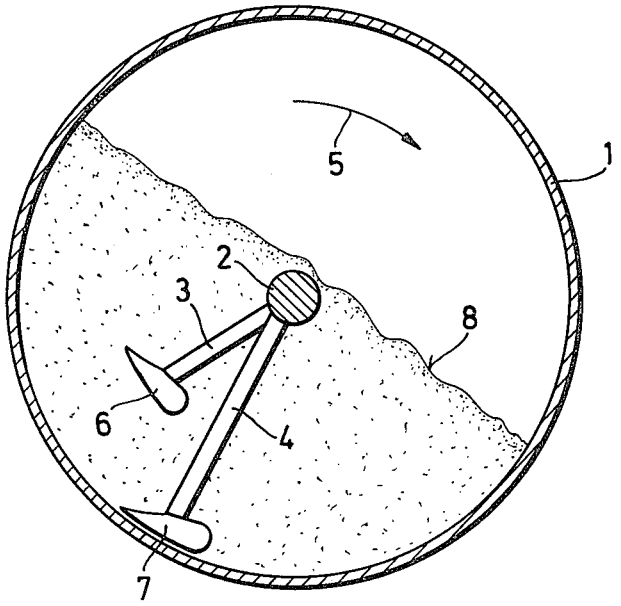
FIG. 1 of the drawings shows diagrammatically a cross-section through an embodiment of the invention in the form of a drum mixer bearing similar mixing tools on radially extending arms of different lengths on a central shaft of the mixing mechanism.

The mixer has a drum-shaped container 1 in the centre of which is rotatably mounted a drivable shaft 2. This shaft carries radially extending arms 3 and 4 of different lengths in different radial planes and distributed spirally, a shorter arm 3 and a longer arm 4 being arranged one behind the other in each radial plane. As considered in the direction of rotation of the drivable shaft 2 shown by an arrow 5, the shorter arm 3 is arranged in front of the longer arm 4 in each case. The angle between the arms, in the illustrated embodiment is an acute angle, i.e., less than 90°.

Mixing tools 6 and 7 are arranged on the ends of the arms 3 and 4 respectively, and in the embodiment shown these are in the form of plough-shares. The mixing tools 7 of the mixing mechanism revolve in the immediate vicinity of the wall of the container 1 while the mixing tools 6 are arranged at a smaller radial distance from the shaft 2 and thus revolve at a greater distance from the wall of the container 1. The mixing tools 6 are preferably smaller than the mixing tools 7.

If the container 1 is filled with a product to be mixed which accumulates in the lower region of the container 1 with an inclined surface 8 when the mixing mechanism is revolving, then the mixing tools 6 and 7 are immersed to different depths into the product piled up in the container 1. The first mixing tool 6 divides the mix product in front of the following mixing tool 7 and thus reduces the load on the arm 4 and the mixing tool 7. This applies particularly if the mixing mechanism revolves at a relatively low speed and the mixed product accordingly lies mainly in the lower region of the mixing container and is ploughed through by the mixing mechanism or is, in part, subjected to a centrifuging and swirling effect.

Figure 2:
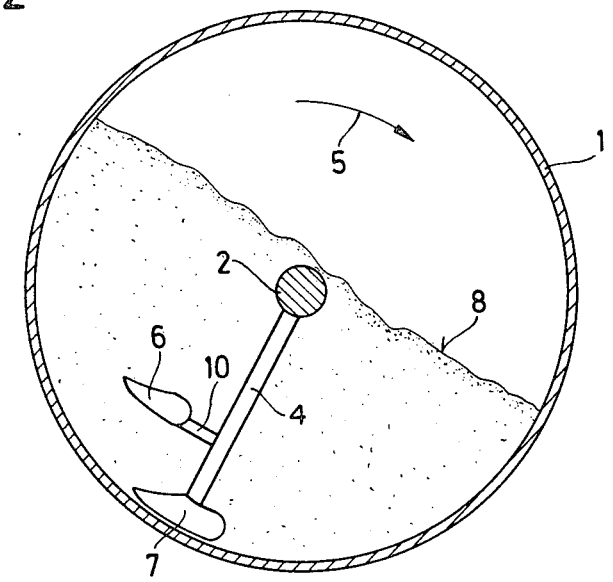
FIG. 2 is a view similar to FIG. 1, and shows another embodiment.

Referring now to FIG. 2 of the drawings, a second embodiment is shown. The construction is similar to that previously described, except that arm 3 has been replaced by arm 10, the latter carried by and generally perpendicular to radially extending arm 4. The other end of arm 10 carries the mixing tool 6, at essentially the same radial and angular portions as occupied in the embodiment of FIG. 1. The mode of operation of this embodiment is the same as that described with respect to FIG. 1.

It is claimed:

1. A mixer comprising a container having a circumferential wall, and a mixing mechanism arranged for concentric rotation with respect to the container, the said mixing mechanism comprising a rotatably mounted shaft carrying at least one radially extending arm, said arm carrying a mixing tool, said mixing tool located in the immediate vicinity of the container wall, a second mixing tool angularly fixed with respect to said first mentioned mixing tool, said second and said first mentioned mixing tool being located in the same radial plane, said second mixing tool being located at a smaller radial distance from the shaft than the said first mentioned mixing tool, said second mixing tool located at an acute angle in advance of the said first mentioned mixing tool, as considered in the direction of rotation of the mixing mechanism.

2. The mixer according to claim 1, wherein the said second mixing tool is fixed to and carried at the outer end of a second radially extending arm secured to said shaft, said second arm being of a lesser length than the first mentioned arm.

3. The mixer according to claim 1, wherein said second mixing tool is carried by a second arm, said second arm at one end thereof being secured to said first mentioned arm, said first mentioned and second arms being generally perpendicular to each other.

4. The mixer according to claim 1, 2 or 3, wherein the said second mixing tool is smaller than the said first mixing tool.

5. The mixer according to claim 4 wherein said container is a cylinder, as in the form of a drum.

* * * * *